United States Patent [19]

Foster et al.

[11] 3,972,525

[45] Aug. 3, 1976

[54] SHEET JOGGING ASSEMBLY

[75] Inventors: Dean Harold Foster, Stratford; William Adamoski, Jr., Stamford, both of Conn.

[73] Assignee: Pitney-Bowes, Inc., Stamford, Conn.

[22] Filed: Feb. 18, 1975

[21] Appl. No.: 550,870

[52] U.S. Cl. ..... 271/221; 271/233; 271/245

[51] Int. Cl.[2] ..... B65H 31/38

[58] Field of Search ..... 271/221, 222, 233, 245, 271/139, 269, 224; 214/65; 227/39; 270/53, 58

[56] References Cited

UNITED STATES PATENTS

| | | | |
|---|---|---|---|
| 763,943 | 6/1904 | Shuman | 271/139 |
| 3,076,196 | 2/1963 | Mestre | 227/39 |

*Primary Examiner*—Evon C. Blunk
*Assistant Examiner*—Bruce H. Stoner, Jr.
*Attorney, Agent, or Firm*—William D. Soltow, Jr.; Albert W. Scribner; Martin D. Wittstein

[57] ABSTRACT

Disclosed is a sheet jogging assembly for use in a sheet registering apparatus in which sheets are collected at a receiving station and arranged in registration with each other for performing an operation on the collected stack of sheets. The invention is utilized particularly in machines for stitching, stapling or punching stacks of sheets which have been collated into booklets, the sheets having been delivered to the stitching, stapling or punching machine by a suitable feeding apparatus. The registering apparatus operates on the rear edge of the sheets after they are deposited on a receiving tray and incorporates mechanism by which a jogging device can be adjustably set to an infinite number of operating positions between predetermined limits which allows the machine to handle sheets ranging from approximately seven inches to approximately fourteen inches in length. The driving assembly for the jogging device is taken directly off the drive for the stitching, stapling or punching machine and the jogging device is adjustable along the driving assembly so that it can be locked in the aforementioned infinite number of operating positions along the driving assembly by the operator. The jogging device includes a jogging assembly having a sheet supporting member which moves back and forth as sheets are jogged into registration. A jogging element having a sheet contacting jogging surface is adjustably mounted on the jogging assembly in order to still further extend the range of positions of operation of the jogging element. An auxiliary adjustment of the paper jogging element allows for still further extension of the range of positions for the jogging element.

6 Claims, 3 Drawing Figures

SHEET JOGGING ASSEMBLY

BACKGROUND OF THE INVENTION

This invention is an improvement in the sheet jogging device of the sheet registration apparatus disclosed and claimed in copending application Ser. No. 550,284, filed Feb. 18, 1975 and assigned to the assignee of this application.

A large variety of machines for performing some type of operation on stacks of sheets are well known in the art, and typical amongst these are machines for stitching, stapling or punching holes in a collation of such sheets. These machines are most often utilized in conjunction with collating machines which take individual sheets of printed material from stacks and collate these sheets into a proper sequence, for example, to form a booklet or pamphlet containing a certain number of pages arranged in a desired order. The collating machine and the stitching stapling or punching machine, as the case may be, are operatively associated together in such a way that the collating machine feeds sheets from successive stacks serially onto a receiving tray of the stitching, stapling or punching machine, on which the sheets are stacked one on top of the other. The sheets are halted on the receiving tray of the stitching, stapling or punching machine in a generally stacked arrangement, and suitable mechanism in the stitching, stapling or punching machines operates to perform the desired function on the stack of sheets. Before this can take place, however, the sheets must be brought into exact registration with each other so that, when the desired operation has been performed, all edges of the sheets in the stack are uniform with each other.

This requirement is achieved by guiding the incoming sheets into proper registration both laterally and longitudinally with respect to the direction of travel of the sheets. Generally, lateral registration has not presented much of a problem since it is a relatively simple matter, as is well known in the art, to provide adjustable side guides which define a channel through which the sheets are moved by whatever feeding mechanism is provded to feed the sheets onto the receiving tray of the stitching, stapling or punching machine, as the case may be. If the side guides are properly adjusted to define a channel substantially the width of the sheets, with no more clearance between the side guides and the edges of the incoming sheets than is necessary for free movement of the sheets, it is a relatively simple matter to align the sheets laterally because the sheets will follow the channel defined by the side guides during their forward movement from the feeding mechanism onto the receiving tray.

Longitudinal registration of the sheets presents a considerably more serious problem than does lateral registration for the reason that longitudinal registration cannot take place until the sheets have reached a predetermined position on the receiving tray and have been brought to a halt by virtue of some obstructing means located in the path of movement of the sheets and beyond which the sheets cannot move until the desired operation has been performed by the stitching, stapling or punching machine. At this point, the rear edge of the incoming sheets must of necessity have passed the jogging device which operates on the rear edge of the sheets, and the jogging device must now operate on sheets which have effectively come to a rest one on top of another. Because of this, it is necessary that any jogging device have a predetermined special relationship with respect to the obstructing mechanism which halts the forward movement of the incoming sheets, and that this special relationship be substantially commensurate with the length of the sheets being registered. In other words, taking into account the degree of movement of the jogging device, it must be located along the tray approximately the same distance from the obstructing mechanism as the length of the sheets being registered. It is apparent that in order for the jogging device to be operable on sheets of varying length, it must be adjustable along the receiving tray in the direction of movement of the sheets.

Typically in prior art machines, as represented by U.S. Pat. No. 3,076,196, a jogging device has been mounted on suitable frame portions of the machine and has incorporated some means for rendering the jogging device adjustable in the direction of movement of the sheets. The disadvantage has been, however, that the jogging device has had to incorporate its own driving motor and the jogging device with the motor has been made adjustable by means which prevented the operator from making any necessary adjustments in a simple and convenient manner. Usually, the jogging device could only be adjusted with the use of tools for loosening connecting devices to allow the jogging device to be loosened on a mounting, move to a desired position, and retightened in the new position, all of which presented an inconvenience and often times difficult procedure for the machine operator. The extent of movement of the prior art devices was usually quite limited in view of interference with other operating components of the machine on which the jogging device is mounted. Another disadvantage of prior art jogging devices is that they often tend to cause the sheets to bounce back and forth against the obstructing means by virtue of the angle at which the jogging finger strikes the rear edge of the sheets, thereby preventing precise registration of the sheets in the longitudinal direction. This is caused by the jogging finger striking the rear edge of the sheets in a slightly upward direction rather than directly along the plane of the sheets or in a slightly downward direction.

SUMMARY OF THE INVENTION

The present invention relates generally to sheet registering apparatus and more particularly to a jogging mechanism for use in particular types of sheet registering apparatus for registering sheets prior to performing an operation thereon.

The present invention finds particular utility in machines of the type which receive sheets of paper, either manually or from other sheet handling machines, which perform some type of operation which facilitates binding the sheets together, usually stitching, stapling or punching holes for insertion of the sheets into a ring binder.

The present invention is utilized in a sheet registering apparatus for a sheet handling machine in which there is a sheet support member which defines a flat surface adapted to receive the sheets and there is an abutment means located at one end of the sheet support member against which the sheets resting on the sheet support surface are to be registered. The sheet jogging assembly is located adjacent the opposite edge of the sheet support member and is operable to engage the edges of the sheets deposited on the sheet support surface for registering the sheets with the abutment means. The registering apparatus is mounted on the sheet support member or other suitable frame portions of the machine for movement along a sheet support surface within predetermined limits in order to facilitate jogging sheets of varying length. A driving means is coupled to the jogging assembly for driving a jogging element, the driving means being mounted at a fixed location with respect to the sheet support member and being coupled to the jogging assembly so as to be operable thereon regardless of the position of the jogging assembly along the sheet support member.

The jogging assembly includes an auxiliary adjustment feature by which, through relocation of the jogging element on its supporting arm, the degree of adjustability provided through the driving assembly for the jogging assembly can be extended; it is the auxiliary adjustment feature which allows the jogging assembly to handle sheets as short as 3 to 4 inches.

Having briefly described the present invention, it is a principal object thereof to provide an improved jogging assembly for sheet registering apparatus.

It is another object of the present invention to provide a sheet jogging assembly in which the jogging surface strikes the rear edges of the sheets in such a manner that the sheets are not lifted over the jogging surface.

It is another object of the present invention to provide a sheet jogging assembly having an adjustment feature whereby the sheet jogging surface is adjustable independently of any adjustment of the sheet registering apparatus.

These and other objects and advantages of the present invention will become more apparent from an understanding of the following detailed description of a preferred embodiment of the present invention when considered in conjunction with the accompanying drawings in which.

DETAILED DESCRIPTION OF THE INVENTION

Figure 1:
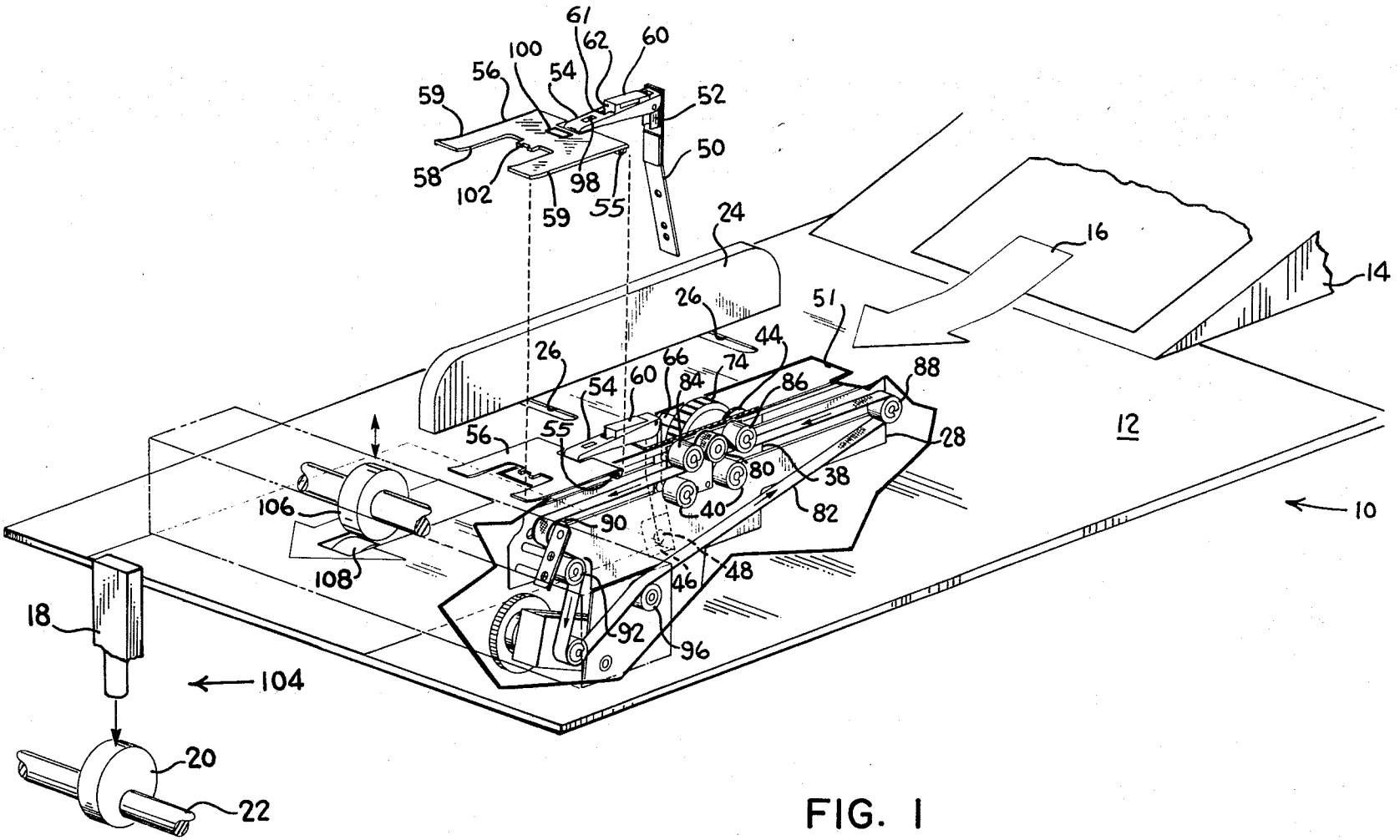
FIG. 1 is a prespective view of the sheet registering apparatus of the present invention with portions broken away for clarity.

Referring now to the drawings, and particularly to FIG. 1 thereof, the sheet registering apparatus, in which the present invention resides is seen to comprise a sheet support means generally indicated by the numeral 10. The sheet support may take any desired form but typically is a tray of rectangular configuration and having an upper sheet supporting surface 12. Sheets of paper are fed onto the surface 12 by any suitable sheet feeding mechanism generally indicated by the reference 14, the feeding mechanism either being an independent unit which is operatively associated with the sheet handling machine or it can be part of a separate sheet handling machine such as the collator mentioned above which itself has a sheet feeding mechanism for directing sheets out of the collator. It is sufficient for an understanding of the present invention to note only that sheets are fed serially onto the support surface 12 as indicated by the arrow 16 by any convenient feeding device.

Sheets which are directed onto the support surface 12 of the tray 10 move thereacross until they reach an abutment means such as the stop member 18, 18, of which any number that is desired can be provided, is a member mounted for movement in a vertical direction by any suitable guide means and is moved upwardly and downwardly by any convenient means such as the cam 20 and shaft 22 indicated in FIG. 1. It is apparent that rotation of shaft 22 and cam 20 will move the stop member 18 upwardly and downwardly to alternately obstruct and permit passage of sheets across the top of the abutment member 18. The particular manner in which the abutment member 18, cam 20 and shaft 22 are mounted is not important to the present invention, since these parts can be conveniently mounted either on the sheet registering apparatus itself or on suitable frame portions of the sheet handling machine with which the registering apparatus is associated. It is, however, necessary to have some form of abutment means located adjacent the end of the sheet support tray 10 to prevent further movement of the sheets while they are being jogged.

The registering apparatus is provided with suitable side guides of which an adjustable side guide 24 is shown in FIG. 1 being mounted on the support tray 10 by means of suitable connectors extending through slots 26 in the tray 10 by which the guide 24 can be locked in a desired laterally position with respect to the tray 10. A similar adjustable guide can be mounted on the opposite side of the tray 10, or, if desired, the opposite side guide can be a fixed member, all as well known in the art. The registering apparatus is connected to the tray 10 by means of a plate 28 which is suitably secured to the tray 10 as by the rivets 30 seen in FIG. 3. The plate 28 is vertically oriented and can be suitably supported in the sheet handling apparatus by means of another plate or frame portion 32 to which the plate 28 is connected. The plate 28 is provided with a pair of longitudinal slots 34 and 36 through which parts yet to be described extend and can move within predetermined limits from one end of these slots to the other.

Another plate 38 is connected to the plate 28 by means of the studs 40, the studs 40 providing for free sliding movement of the plate 38 with respect to the plate 28 along the slot 36. The plate 38 can be locked in any desired position along the plate 28 by means of a locking screw assembly which includes a non-rotatable stud 42 shown in FIG. 2 projecting through the upper slot 34 of the plate 28 and being provided with a threaded hand wheel 44 which projects above the upper edge of the plate 28 as best seen in FIG. 1. By tightening the hand nut 44, the plate 38 is locked to the plate 28 and no relative movement therebetween is possible; conversely by loosening the hand nut 44 the plate 38 can be moved longitudinal relative to the plate 28 to any desired position.

Figure 2:
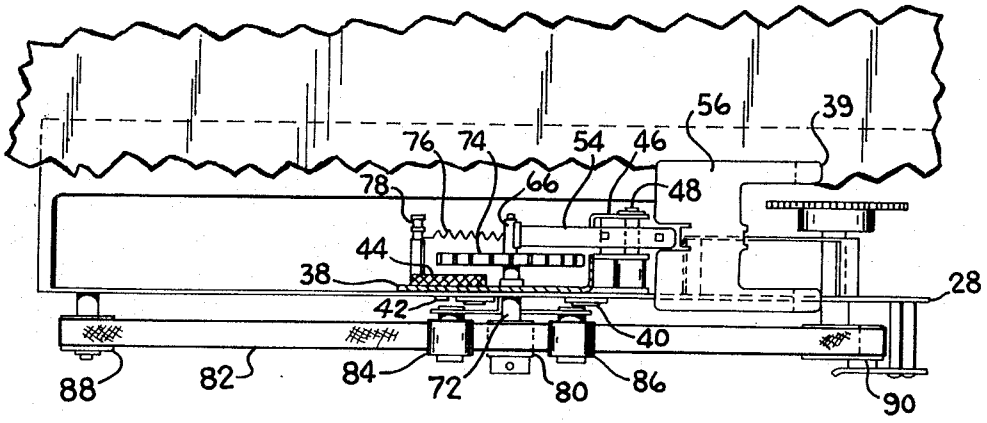
FIG. 2 is a plane view of a portion of the sheet registering apparatus shown in FIG. 1 but oriented in the opposite direction from the view of FIG. 1.

The registering apparatus includes a movable jogging device which is itself mounted on the plate 38 for movement therewith. This device comprises a bracket 46 pivotally mounted on a short stub shaft 48 which in turn is mounted on the plate 38. An elongate arm 50 is connected to the bracket 48, the arm 50 extending upwardly through an elongate slot 51 which extends along a major portion of the length of the tray 10. The finger 50, which is best shown in FIG. 1 in perspective is angled at approximately its midpoint, and has a bracket 52 mounted adjacent the upper end of the finger 50 which in turn supports a horizontal arm 54 which is pivotally connected to the bracket 52 at one end, the arm 54 being pivotally connected to a scraper 56 which normally rests on the upper surface 12 of the support tray 10 to define a pair of fingers 59 the free ends of which slide on the upper surface 12 of the support tray 10. A roller 55 is mounted on the arm 54 at the end where the scraper 56 is connected to the arm 54, the roller being supported by a shaft not shown in the drawings and being adapted to ride on the surface 12 of the support tray 10. The blade 56 is bifurcated as indicated at 58 to define a pair of fingers 59 the free ends of which slide on the upper surface 12 of the support tray 10. As best seen in FIG. 2, the scraper 56 is angled slightly downwardly toward the free end of the fingers 59, and the scraper is adapted to support the rear portion of the sheets deposited on the support tray 10.

The jogging finger 60 is mounted on the arm 54 and is provided with a forwardly facing jogging surface 62 which is the portion of the jogging mechanism that actually contacts the rear edge of the sheets being registered. This relationship is clearly shown in FIG. 3 wherein a sheet 64 is shown in the registration position with the front edge of the sheet bearing against the stop member 18 and the rear edge of the sheet being engaged in the forwardmost position of the jogging finger 60 by the jogging surface 62. It can be seen that since the jogging finger 60, being pivotally connected to the bracket 52 of the arm 50, which in turn is pivotally mounted on the stub shaft 48, facilitates forward and backward movement of the jogging finger 60 about the axis of the shaft 48 while the jogging finger 60 partakes of reciprocatory movement toward and away from the rear edge of the sheet 64. By virtue of the pivotal connection of the arm 54 to the bracket 52, together with the angled disposition of the scraper 56 with respect to the support tray 10, the jogging surface 62 of the jogging finger 60 always remains in the same plane which is preferably perpendicular to the rear edge of the sheet or angled slightly downwardly with respect thereto. By this construction there is no tendency for the jogging finger 60 and its jogging surface 62 to cause the rear edge of sheets to move upwardly and out of contact with the jogging finger and thereby result in sheets bouncing back out of registration after having contacted the abutment element 18.

The arm 50 and therefore the jogging device thus far described, is rocked back and forth about the axis of the shaft 48 by means of a pin 66 which is eccentrically mounted on an urge wheel 68, the urge wheel 68 being connected to a shaft 70 which is rotatably mounted in a bearing 72 which in turn is fixed to the plate 38. The urge wheel 68 is provided with a rubber tire 74 and projects sufficiently far above the surface 12 of the tray 10 through the slot 52 to engage the underside of sheets being directed onto the plate 10 by the aforementioned feeding mechanism 14. The urge wheel, which is rotated by means hereafter described, rotates continuously during operation of the registering apparatus to direct the incoming sheets toward the stop member 18 even though the only feeding cooperation between the urge wheel 68 and the incoming sheets is the weight of the sheets resting on the urge wheel as the result of gravity.

Figure 3:
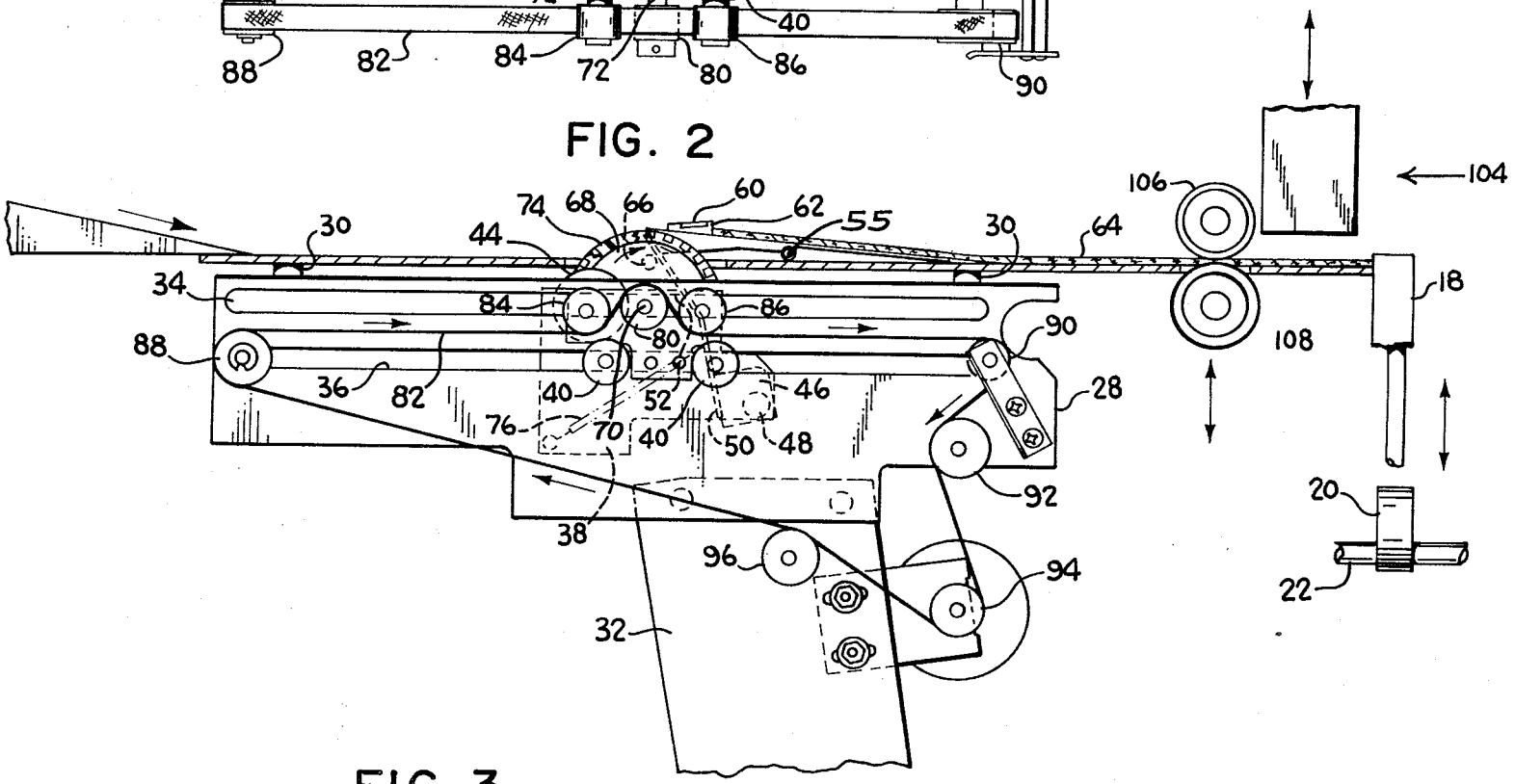
FIG. 3 is a side view of the sheet registering apparatus shown in FIG. 2.

Another function of the urge wheel is to provide a convenient mounting and driving means for the eccentric pin 66. As the urge wheel 68 rotates, the eccentric pin 66 is carried therewith to alternately engage and disengage the rear surface of the arm 50 along the upper portion thereof. As best seen in FIGS. 2 and 3, the arm 50 is urged in a rearward direction by a spring 76 which is connected to the arm 50 and to a pin 78 also mounted on the plate 38. The spring 76 tends to maintain the arm 50 up against the pin 66 as the latter rotates. Thus, it will be apparent that as the urge wheel 68 rotates in the direction of the arrow shown in FIG. 2, the pin 66 will orbit about the axis of the urge wheel 68 and the arm 50 with the above described parts connected thereto will reciprocate in a backward and forward movement as the arm 50 follows the pin 66 about its orbital path, the arm 50 pivoting about the shaft 48 as described here-above. The extent of reciprocatory movement of the jogging finger 60 is set by the extent to which the pin 66 is eccentrically mounted on the urge wheel 68 with respect to the central axis of the urge wheel 68.

The urge wheel 68 is rotated by a driving means which is coupled to the urge wheel for driving the latter regardless of its position along the plate 28 and without any movement of the driving means which is fixed in position with respect to the plate 28. This driving means comprises a pulley 80 mounted on the shaft 70 beyond the collar 72 so as to drive the shaft 70 when the pulley 80 is driven. The pulley 80 is driven by a belt 82 which passes over the upper surface of the pulley and is wrapped around the pulley over a substantial arc by means of the idler rollers 84 and 86, the idler rollers 84 and 86 in turn being mounted on the plate 38 for movement therewith in any convenient manner. The belt 82 passes around another pulley 88 which is rotatably mounted on the plate 28. In the opposite direction, the belt 82 passes around idler rollers 90 and 92 to a driving roller 94 and then back to the idler roller 88, passing over a suitable tensioning roller 96. The driving roller 94 may be driven by an independent motor or more preferably constitutes a power take-off from the main driving mechanism of the sheet handling machine with which the jogging mechanism of the present invention is associated. It will be seen that the portions of the belt 82 between the idler rollers 84 and 88 and idler rollers 86 and 90 lie in a common plane and are parallel to the slots 34 and 36 formed in the plate 28. From this arrangement it can be seen that the belt 82, when driven by the roller 94, will drive the pulley 80 regardless of the position of the latter along the plate 28. It will also be apparent that since the bearing 72 in which the shaft 70 rotates projects through the slot 34 in the plate 28 that the plate 38 with all of the mechanism mounted thereon can be moved along the plate 28 to any desired position without disturbing relationship between the belt 82 and the pulley 80.

Referring back to FIG. 1 and the jogging assembly shown in exploded form, it will be seen that the arm 54 includes a plurality of openings 98 into which downwardly projecting tabs 61 on the jogging finger 60 project so as to lock the jogging finger 60 into the arm 54. The jogging finger 60 is removable from the arm 54 simply by lifting the jogging finger 60 against the tension of the downwardly projecting tabs. The jogging finger 60 can be inserted into any of the openings 98 in order to adjust the location of the jogging finger 60 along the arm 54. It will be noted that the blade 56 also includes an opening 100 and a notch 102 located at the bottom of the bifurcated portion of the scraper 56, the opening 100 and the notch 102 serving to provide additional receptacles for the tabs on the underside of the jogging finger 60 so that the latter can be mounted on the surface of the scraper 56 itself. This construction provides three separate locations for mounting of the jogging finger 60 on the jogger assembly which provides the degree of auxiliary adjustment of the jogging finger 60 along the sheet receiving tray 10 heretofore mentioned.

There is schematically shown in FIG. 3 an operating mechanism generally indicated by the numeral 104 which may, for example, be a stitching head which applies a staple along the edge of the registered sheets after they have been jogged into position by the jogging mechanism of the present invention. In a typical example of such a paper handling machine, at a predetermined time after sufficient jogging of the sheets has taken place to assure registration thereof, the operating mechanism 104 would be caused to perform its operation on the registered sheets, after which the stop member 18 would be withdrawn to its lower position and suitable rollers 106 and 108 brought into operative engagement to eject the stack of sheets on which the operation has been performed from the tray 10. This latter mechanism is not essential to the present invention and is shown only for the purpose of illustrating the present invention in operative relationship with a paper handling machine of the type generally referred to above.

In the operation of the device as described above, the jogging mechanism is initially adjusted by the operator taking a sheet of paper and placing it on the sheet receiving tray 10 with the front edge of the sheet up against the stop element 18. The operator loosens the tightening nut 44 so as to allow the plate 38 to slide freely longitudinally of the sheet receiving tray 10 with respect to the plate 28. The plate 38 can be moved by either one of two convenient procedures, one being to grasp the urge wheel 68 so that it cannot rotate and pushing it forwardly or backwardly to the desired position during which the belt 82 will slip on the pulley 80 since the latter is being held against rotation by grasping of the urge wheel 68. In so doing, it is necessary to have first rotated the urge wheel 68 in order to bring the pin 66 mounted thereon into its forwardmost position so that further rotation of the urge wheel will only result in rearward movement of the jogging finger 60. With the urge wheel 68 rotated to this position it can be moved backward or forward to bring the jogging surface 62 of the jogging finger 60 into contact with the sheet of paper which the operator has previously placed on the tray 10. This will establish the forwardmost position of the jogging surface 62. An alternative means of moving the jogging assembly to the desired position is to manually drive the belt 82 forwardly or backwardly while the tightening nut 44 is still loose. Because of the tension on the belt 82 there is less frictional resistance to the plate 38 and its associated structure moving backward and forward then there is in rotation of the urge wheel with the result that by so moving the belt 82 manually with the tightening nut 44 loosened, the plate 38 and its associated structure will move backward and forward rather than the urge wheel turning. It is, of course, necessary during this procedure to have first rotated the urge wheel 68 to a position where the pin 66 pushes the jogging finger 60 to its forwardmost position so that any further rotation of the pin 66 in its orbital path once the mechanism is locked in place will only result in rearward movement of the jogging finger 60. After the forwardmost position of the jogging surface 62 has been established by either of the procedures above described, the tightening nut 44 is rotated in a direction to lock the plate 38 to the plate 28 so as to prevent any further relative movement between these plates. The jogging apparatus is now ready for operation in its normal manner, which is that as the driving roller 94 rotates the belt 82, the belt in turn rotates the urge wheel 68 and causes the pin 66 to orbit around the axis of the urge wheel 68 and engage the rear surface of the arm 50 to cause the jogging assembly to oscillate back and forth about the shaft 48 as described above. When the desired number of sheets 64 have been jogged into position of registration with one another against the stop member 18, the operating mechanism 104 is caused to perform its operation on the register sheets, for example insert a staple or other fastening device through the sheets, after which the stop member 18 is withdrawn and the roller 108 is caused to move upwardly into driving relationship with the roller 106 with the registered sheets therebetween to eject the stapled sheets into a suitable receiving tray.

It should be remembered that if the amount of adjustment of the jogging assembly which is permitted by relative movement of the plate 38 with respect to the plate 28 is insufficient to bring the jogging assembly into proximity to the stop member 18 to jog short sheets, it is possible to obtain further adjustment of the jogging surface 62 toward the stop member by relocating the jogging finger 60 into one of the other pairs of openings 98 or the slot 102 in a direction toward the stop member 18. Similarly, it is possible to obtain further adjustment of the jogging surface 62 away from the stop member 18 beyond the farthestmost position permitted by relative movement of the plate 38 with respect to the plate 28 by locating the jogging finger 60 in the opening 98 furthest away from the stop member 18.

What is claimed is:

1. A sheet jogging assembly for use in sheet registration apparatus in which sheets deposited in a stack are jogged into registration with each other prior to an operation being performed on the registered stack, said jogging assembly comprising:

a. a first generally vertically oriented arm having means on the lower end thereof for pivotally mounting said arm on a portion of the sheet registering apparatus in a position such that the jogging assembly is in operative association with a stack of sheets in the sheet registering apparatus, b. a second arm pivotally connected to one end thereof to the upper end of said first arm and disposed generally perpendicularly to said first arm, c. means pivotally connected to the other end of said second arm for supporting the rear portion of a stack of sheets while the sheets in the stack are being jogged into registration with each other by said jogging assembly when the jogging assembly is moved back and forth about the pivotal connection of said first arm to the sheet registering apparatus, said supporting means defining an extension of said second arm, d. a jogging element mounted on said second arm or said supporting means in one of a plurality of selectable positions therealong for contacting the rear edges of sheets deposited in the stack for jogging the sheets into registration, and e. means cooperable between said jogging element and said second arm and said extension thereof for removably mounting said jogging finger in any one of said plurality of positions whereby said jogging assembly jogs sheets of different length depending on the position of said jogging element along said plurality of selectable positions.

2. A jogging assembly as set forth in claim 1 wherein said second arm carries a roller at said other end of said second arm, said roller rolling on a sheet receiving surface of a sheet support member forming part of the sheet registration apparatus to support said other end of said second arm and the adjacent end of said supporting means for free movement thereof on the surface of the sheet support member.

3. A jogging assembly as set forth in claim 2 wherein said supporting means comprises a generally rectangular member having a pair of fingers protruding from the free edge of said member, the remote ends of said fingers being adapted to slide on said sheet receiving surface, said member being disposed at a slight angle with respect to said sheet receiving surface so as to support said rear portion of the stack of sheets in a desired relationship relative to said jogging element.

4. A jogging assembly as set forth in claim 3 wherein said jogging element comprises a jogging finger having a jogging surface thereon disposed substantially perpendicularly to the plane of said rectangular member whereby said jogging surface strikes the rear edges of the sheets supported by said rectangular member perpendicularly to the plane of the sheets.

5. A jogging assembly as set forth in claim 1 wherein said cooperable mounting means comprises spaced apart tabs projecting downwardly from said jogging element and correspondingly spaced apart openings in said second arm and said supporting means said tabs fitting into said openings with sufficient tension to retain said jogging element in place in a selected one of said plurality of positions.

6. A jogging assembly as set forth in claim 5 wherein said supporting means comprises a generally rectangular member which is bifurcated at its free end to define a recess between a pair of outwardly protruding fingers, and wherein there is a further recess within said first mentioned recess shaped to receive one of said downwardly protruding tabs of said jogging element.

* * * * *

UNITED STATES PATENT OFFICE
CERTIFICATE OF CORRECTION

Patent No. 3,972,525 Dated August 3, 1976

Inventor(s) Dean Harold Foster and William Adamoski, Jr.

It is certified that error appears in the above-identified patent and that said Letters Patent are hereby corrected as shown below:

Column 1, line 42, change "provded" to --provided--.

Column 4, line 1, change the first occurrence of "18," to --18.-- and before the second occurrence of the number "18," insert --The stop member--

Column 6, line 28, change "38" to --36--.

Claim 1, column 8, line 48, change "to" to --at--.

Signed and Sealed this

Ninth Day of November 1976

[SEAL]

*Attest:*

RUTH C. MASON
*Attesting Officer*

C. MARSHALL DANN
*Commissioner of Patents and Trademarks*